United States Patent [19]

Oliff

[11] Patent Number: 4,679,726

[45] Date of Patent: Jul. 14, 1987

[54] END CLOSURE STRUCTURE FOR AN END LOADING CARTON

[75] Inventor: James R. Oliff, Austell, Ga.

[73] Assignee: The Mead Corporation, Dayton, Ohio

[21] Appl. No.: 820,524

[22] Filed: Jan. 17, 1986

[51] Int. Cl.[4] ..... B65D 5/08

[52] U.S. Cl. ..... 229/138; 206/427; 229/40; 229/137

[58] Field of Search ..... 229/40, 132, 136, 137, 229/138, 155, 158, 134; 206/427, 434, 140

[56] References Cited

U.S. PATENT DOCUMENTS

| | | | |
|---|---|---|---|
| 1,037,347 | 9/1912 | Smith | 229/138 |
| 3,094,265 | 6/1963 | Hovland | 229/138 |
| 3,229,890 | 1/1966 | Wright | 229/137 |
| 3,934,791 | 1/1976 | Dick et al. | 229/134 |
| 3,955,748 | 5/1976 | Calvert | 229/40 |
| 4,216,861 | 8/1980 | Oliff | 206/427 |
| 4,398,636 | 8/1983 | Baxter | 229/40 |

*Primary Examiner*—Stephen Marcus
*Assistant Examiner*—Gary E. Elkins
*Attorney, Agent, or Firm*—Rodgers & Rodgers

[57] ABSTRACT

An end of a carton having foldably joined top, bottom and side walls forming a tubular structure is closed by a pair of closure panels foldably joined to the end edges of the side walls respectively, closure flaps foldably joined to the corresponding end edges of the bottom and top walls respectively, one of the closure panels being folded inwardly followed by inward folding of both closure flaps into face contacting relation with the outer surface of the one closure panel followed by inward closing of the other closure panel into face contacting relation with the outer surfaces of the closure flaps and of the one closure panel so as to envelope the closure flaps between the closure panels.

8 Claims, 5 Drawing Figures

END CLOSURE STRUCTURE FOR AN END LOADING CARTON

TECHNICAL FIELD

This invention relates to the packaging of a plurality of primary packages such as cans in an end loading carton and is primarily concerned with improved closure structure for the ends of such a carton.

BACKGROUND ART

U.S. patent application Ser. No. 695,184 filed Jan. 28, 1985, now Pat. No. 4,577,799, and owned by the assignee of this invention discloses an end loading carton having end closure structure which utilizes interlocking structure similar to that of the present invention but which incorporates a different orientation of end closure panels and end closure flaps.

DISCLOSURE OF THE INVENTION

According to this invention in one form an end of an end loading carton is closed by a pair of closure panels foldably joined to corresponding end edges of the carton side walls respectively together with a pair of closure flaps foldably joined to corresponding end edges of the bottom and top walls respectively, one of said closure panels being folded inwardly to an end closing position followed by inward folding of the closure flaps and subsequently by inward folding of the other closure panel so as to envelope the closure flaps between the closure panels. The flaps and panels are secured together in such manner as to form a secure end closure for the carton which is especially adapted to prevent outward bulging of the end closure structure.

BEST MODE OF CARRYING OUT THE INVENTION

Figure 1:
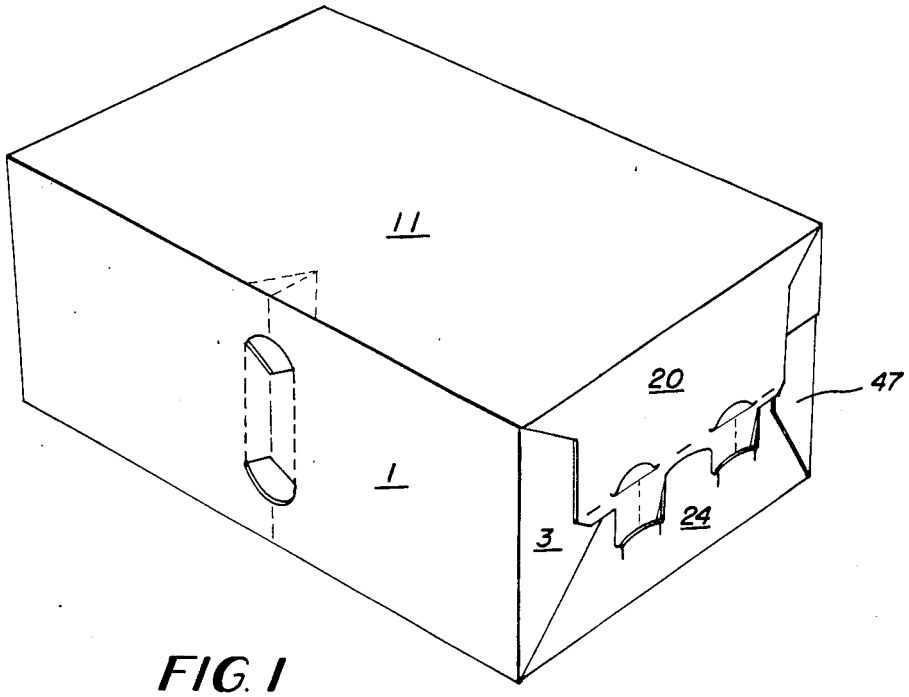
FIG. 1 is a perspective view of a finished and closed carton formed according to this invention.

With reference to the drawings, the numeral 1 designates the top wall of the carton to the ends of which flaps 2 and 3 are foldably joined along end fold lines 4 and 5 respectively. Handle flaps 6 and 7 are foldably joined to top wall 1 along fold lines 8 and 9 respectively, the handle flaps 6 and 7 being separated by a perforated slit 10 which extends completely across top wall 1 and downwardly into the side walls 11 and 12 as indicated at 10*a* and 10*b*. Weakened fold lines 13 and 14 are formed in side wall 11 while similar fold lines 15 and 16 are formed in side wall 12.

The structure of the handles 6 and 7 is more fully disclosed and claimed in U.S. Pat. No. 4,558,816 issued Dec. 17, 1985 and owned by the assignee of this invention.

Side wall 11 is foldably joined to top wall 1 along fold line 17 while side wall 12 is foldably joined to top wall 1 along fold line 18.

End closure panels 19 and 20 are foldably joined to side wall 11 along fold lines 21 and 22 respectively while end closure panels 23 and 24 are foldably joined to the end edges of side wall 12 along fold lines 25 and 26 respectively.

Heel and toe locking tabs 27 and 28 are foldably joined along interrupted fold line 29 to end closure panel 19 while heel and toe type locking tabs 30 and 31 are foldably joined to end closure panel 20 along interrupted fold line 32. For cooperating with heel and toe locking tabs 27 and 28, locking apertures 33 and 34 are formed in closure panel 23 while locking apertures 35 and 36 are formed in closure panel 24 and arranged to cooperate with locking tabs 30 and 31 respectively.

Closure flap 2 is interconnected with closure panel 19 by web 37 which is foldably joined to flap 2 along fold line 38 and to end panel 19 along fold line 39. Similarly web 40 is interconnected with end flap 3 along a fold line 41 and with end panel 20 along a fold line 42.

Bottom panel 43 is foldably joined to the bottom edge of side wall 12 along fold line 44 and end flap 45 is foldably joined to bottom panel 43 along fold line 46. End flap 47 is foldably joined to an end of bottom panel 43 along fold line 48.

At the other end of the blank a glue flap 49 is foldably joined to side wall 11 along fold line 50 while end tab 51 and 52 are foldably joined to glue flap 49 along fold lines 53 and 54 respectively.

Web 55 is foldably joined to end panel 19 along fold line 56 and to end tab 51 along fold line 57. Similarly web 58 is foldably joined to end panel 20 along fold line 59 and to end tab 52 along fold line 60.

Figure 2:
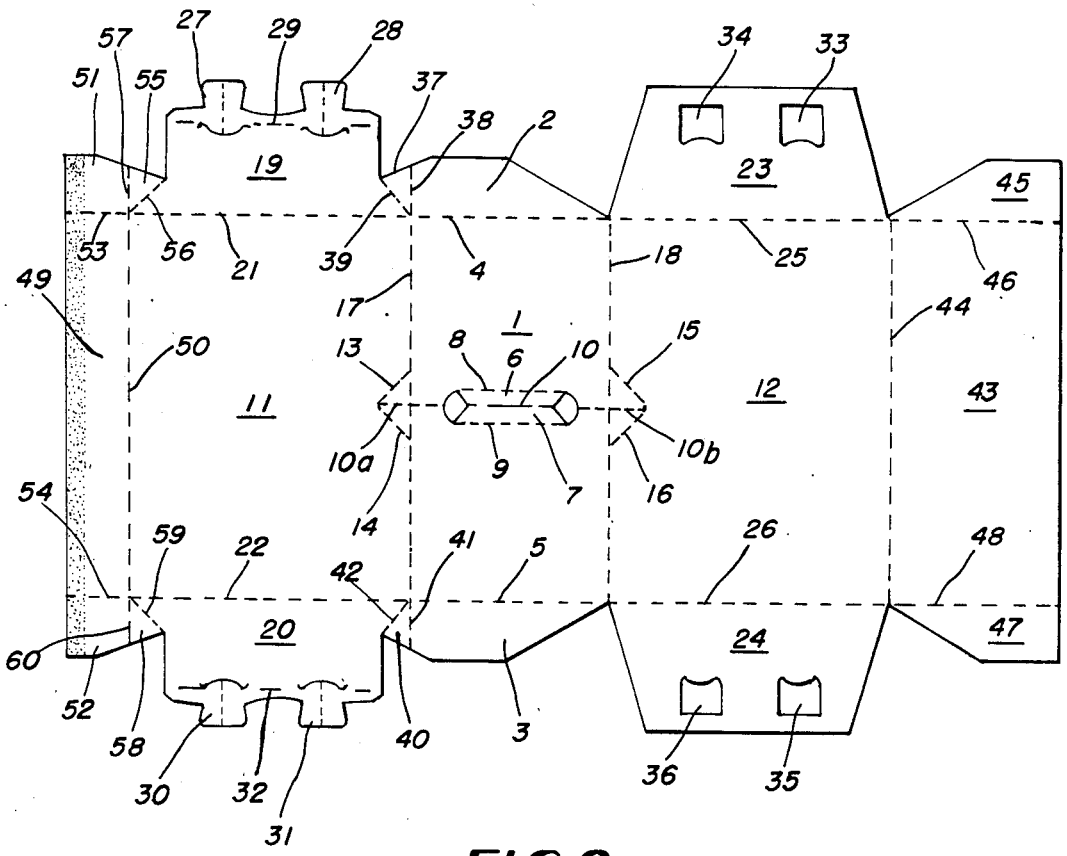
FIG. 2 is a plan view of the inner surface of a unitary blank from which the carton of FIG. 1 is formed.
Figure 3:
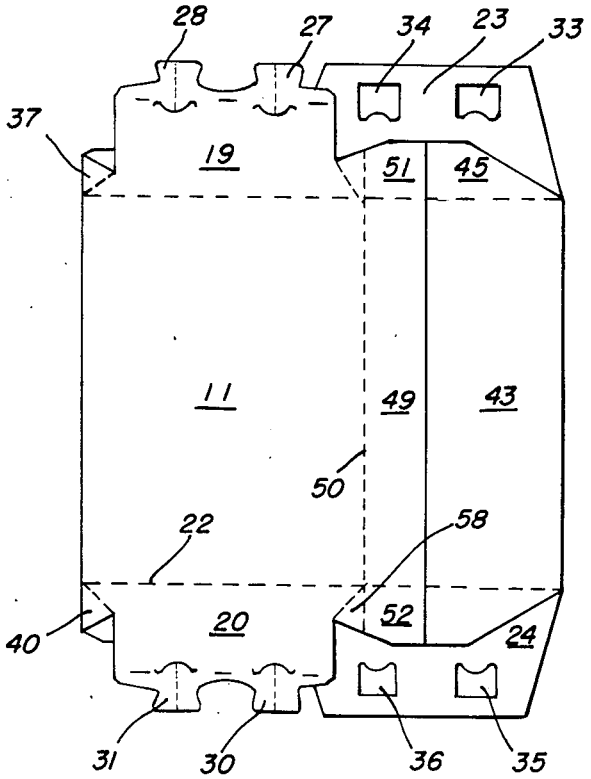
FIG. 3 is a view of a collapsed carton formed from the blank of FIG. 2.

In order to manipulate the carton blank as shown in FIG. 2 in the collapsed form shown in FIG. 3, an application of glue is first made to one side of the inner surface of glue flap 49 as shown by stippling in FIG. 2. Thereafter bottom wall 43 is elevated and folded toward the left along fold line 44 while side wall 11 is elevated along with glue flap 49 and folded toward the right along fold line 17 to cause the glue flap 49 to become adhered to the bottom wall 43. The collapsed carton then appears as shown in FIG. 3.

The collapsed carton as shown in FIG. 3 is set up with its ends open and is then loaded through its ends. Thereafter the ends are closed as represented in FIGS. 4 and 5.

Figure 4:
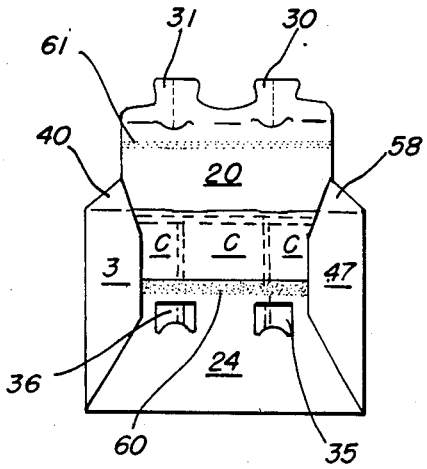
FIG. 4 is an end view of a set up and loaded carton formed according to this invention with some of the closure structure folded inwardly and with one of the closure elements folded outwardly and FIG. 5 is a view similar to FIG. 4 but which shows the carton closing structure in its closed position.
Figure 5:
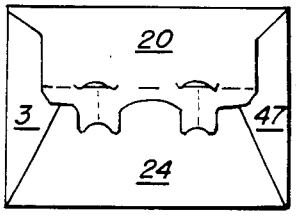

With reference to FIG. 4, the end panel 24 is folded upwardly and inwardly to its closed position followed by upward and outward folding of closure panel 20. Upward and outward folding of closure panel 20 causes the end flaps 3 and 47 to swing inwardly due to the interconnection of the end flaps 3 and 47 with the adjacent edges of closure panel 20 through webs 40 and 58. Preferably the end flaps 3 and 47 are adhered to the end panel 24 by means of an adhesive on panel 24 indicated by stippling 60. Thereafter closure panel 20 is folded downwardly along fold line 22 to its closed position and locks 30 and 31 are manipulated into locking engagement with the apertures 35 and adjoining means including 36 respectively. Function of the these locking tabs and locking apertures is more fully described in the above mentioned U.S. patent application Ser. No. 695,184 owned by the assignee of this invention.

When the closure panel 20 is folded to its closed position adjoining means including the adhesive 60 becomes adhered to the inner surface of closure panel 20. Thus the flaps 3 and 47 as well as the panels 20 and 24 are secured together by the adhesive and in addition the panels 20 and 24 are mechanically interlocked to form a secure end closure for the carton.

If desired, an application of glue may be made to the inner surface of closure panel 20 as indicated by stippling at 61. Of course this adhesive becomes adhered to the outer surfaces of end flaps 3 and 47 and to the outer surface of closure panel 24. Adhesive 60 and 61 may both be used, if desired, or in certain applications of the invention either one or the other adhesive applications may be used. Thus the structure according to this invention forms a secure closure for the end of an end loading carton and prevents bulging of the closure structure which frequently occurs due to stacking of one carton above another during palletizing and storage operations and the like.

Of course the finished carton appears as shown in FIG. 5 in fully closed condition.

INDUSTRIAL APPLICABILITY

This invention is particularly well suited for use in packaging primary packages such as cans having recessed ends. Such cans are frequently described as two piece cans and frequently the lower end of a palletized can is aligned with the upper recessed end of a lower can and thus causes an outward bulging of the end structure which outward bulging is prevented according to the secure closure structure formed according to this invention.

I claim:

1. End closure means for an end loading carton having foldably joined top bottom and side walls forming a tubular structure, said closure means comprising a pair of closure flaps foldably joined to an end edge of said bottom and said top walls respectively, a pair of closure panels foldably joined to corresponding end edges of said side walls respectively, foldable web structure foldably joined to a side edge of each of said closure flaps and to the adjacent side edge of one of said closure panels to form interconnections therebetween, the other of said closure panels being folded inwardly to its end closing position and said one of said closure panels being folded outwardly so as to impart a closing force inwardly to said closure flaps through said webs to move said closure flaps toward closed positions overlapping said other closure panel following which said one closure panel is closed into overlying relation with said web structures and into overlapping relation with said closure flaps and said other closure panel, and adjoining means securing said closure panels and said closure flaps together.

2. End closure means according to claim 1 wherein said closure panels are mechanically interlocked in overlapping relation with each other.

3. End closure means according to claim 1 wherein said adjoining means comprises adhesive means bonding said closure panel to said closure flaps.

4. End closure means according to claim 3 wherein said adjoining means comprises adhesive means bonding said other closure panel to said one closure panel.

5. End closure means according to claim 2 wherein said adjoining means comprises locking apertures in said other closure panel for receiving corresponding locking tabs foldably joined to said one closure panel.

6. End closure means according to claim 5 wherein said locking tabs are rotatable and include a heel at one extremity and a toe at the other.

7. End closure means according to claim 1 wherein said adjoining means comprises adhesive means bonding said one closure panel to said closure flaps.

8. End closure means according to claim 7 wherein said adjoining means comprises adhesive means bonding said one closure panel to said other closure panel.

* * * * *